United States Patent [19]

Mizuochi

[11] 3,994,086

[45] Nov. 30, 1976

[54] REFLEX LIGHT REFLECTOR

[75] Inventor: Hisayuki Mizuochi, Sano, Japan

[73] Assignee: Seibu Polymer Kasei Kabushiki Kaisha, Japan

[22] Filed: Dec. 31, 1974

[21] Appl. No.: 538,000

[30] Foreign Application Priority Data

Jan. 9, 1974 Japan ..... 49-5809

[52] U.S. Cl. ..... 40/135; 350/105

[51] Int. Cl.[2] ..... G09F 13/16

[58] Field of Search ..... 40/135, 125 R, 125 N, 40/125 F; 350/105, 106

[56] References Cited

UNITED STATES PATENTS

| | | | |
|---|---|---|---|
| 2,407,680 | 9/1946 | Palmquist et al. | 40/125 F UX |
| 3,222,986 | 12/1965 | Altman | 350/105 X |
| 3,413,058 | 11/1968 | Tung et al. | 350/105 |
| 3,708,378 | 1/1973 | Tung | 40/135 X |

*Primary Examiner*—John F. Pitrelli

*Attorney, Agent, or Firm*—Brisebois & Kruger

[57] ABSTRACT

A reflex light reflector or reflective structure whereby incident light is reflected from a reflective layer on the rear of the structure through a plurality of small transparent balls, wherein a transparent flat coating layer is formed over the surfaces of said balls, said layer being composed of two sub-layers between which is provided a printed surface using fine lines for printing, such that the printed matter is visible in scattered light in the daytime but invisible in reflected light in the nighttime.

9 Claims, 4 Drawing Figures

REFLEX LIGHT REFLECTOR

BACKGROUND OF THE INVENTION

This invention relates to a reflex light reflector, and more particularly to a reflex light reflector having a printed surface, the printed matter on which is visible under scattered light in the daytime but invisible in the nighttime.

BRIEF DESCRIPTION OF THE PRIOR ART

In the currently used reflex light reflectors, the printed surface for reflecting the incident light is provided behind the small transparent balls in the reflector. Therefore, when high-brightness reflection is required, it is necessary to form print on the mirror surfaces concentric with the small transparent balls. In other words, it is necessary to apply uniform printing on a plurality of concave mirror surfaces. It is, however, extremely difficult to accomplish this on such surface portions which do not lie on the same plane. Thus, a certain decline in brightness has been considered inevitable in conventional reflex light reflectors.

SUMMARY OF THE INVENTION

The present invention has solved these problems of the prior art, and has as its object to provide a novel reflex light reflector having a printed portion or print which is readily and distinctly visible under scattered light in the daytime but invisible under reflected light in the nighttime, and wherein the printing of said printed portion can be accomplished with ease.

Another object of the present invention is to devise a reflex light reflector of the type described, wherein a printed portion is provided in a transparent layer which constitutes the surface coating layer of the reflector.

Still another object of the present invention is to devise a reflex light reflector of the type described wherein said surface coating layer is composed of two sub-layers and a printed portion is positioned between said two sub-layers.

Yet another object of the present invention is to provide a reflex light reflector of the said type wherein the printed member formed in said surface coating layer is formed by lines having a thickness of less than 0.5 mm.

The other object and advantages of the present invention will become apparent as this invention is more fully described hereinafter, with reference to the accompanying drawings, in which.

DETAILED DESCRIPTION OF THE INVENTION

Figure 1:
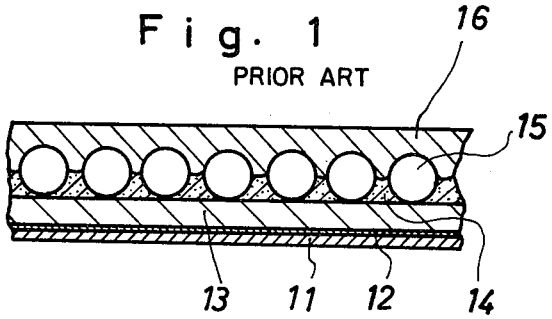
Fig. 1 PRIOR ART
FIG. 1 is a longitudinal sectional view showing a prior art reflex light reflector.

In currently used reflex light reflectors, as exemplified in FIG. 1, a printed layer 12 is provided on one side of the reflective layer 11, and a spacing layer 13, a binder layer 14 having embedded therein a plurality of small transparent balls 15, and a surface coating layer 16 are laminated in that order on said printed layer 12. The internal light reflective layer carries a printed layer composed of printed material formed from particles of a material which allows semi-mirror-reflection and an unprinted mirror-reflection material. Said printed material has a pattern the width of the lines of which does not at any part exceed about 1/64th of an inch. The printed material is also such that its total reflective strength in the visible spectrum is 40 to 90% of the total mirror-surface reflection strength shown by the unprinted material in the visible spectrum.

However, when a reflex light reflector with high brightness is required, the internal light reflective layer must be formed as a mirror surface which is concentric with the small transparent balls 15 embedded in front of said layer. Thus as aforementioned, it was not an easy job to uniformly print the plurality of concave mirror surfaces.

Now, a preferred embodiment of the present invention will be described with reference to FIGS. 2 and 4.

Figure 2:
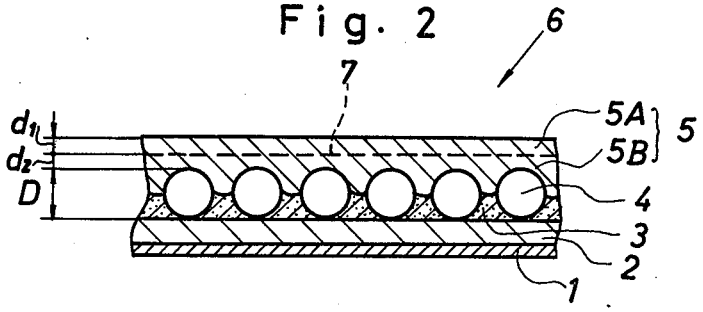
FIG. 2 is a longitudinal sectional view showing a reflex light reflector according to the present invention.

FIG. 2 shows the construction of a reflex light reflector 6 according to the present invention comprising a reflective layer 1 at the bottom, a transparent spacer layer 2 above the reflective layer 1, a transparent binder layer 3 on said spacer layer 2, a plurality of small transparent balls 4, arranged regularly and half embedded in said binder layer 3, and a transparent surface coating layer 5 covering the surfaces of said small transparent balls 4 and flat at its upper surface. Said surface coating layer 5 is composed of two sub-layers 5A and 5B, and printing 7 is provided at the interfacial boundary between said two sub-layers 5A and 5B. In this reflector 6, the reflective layer 1 is formed by the deposition of metal such as aluminum having a thickness of 200 A and is integral with the spacing layer 2. This spacing layer 2 is formed from transparent thermosetting acrylic resin having a refractive index of 1.52 and a weight per unit area of 30 to 35 g/m$^2$. The binder layer 3 is also made of transparent thermosetting acrylic resin having a weight per unit area of 25 to 28 g/m$^2$.

Each of the small transparent balls 4 is a transparent spherical body with a refractive index of 2.2 and a grain size of 0.006–0.009 cm. Both of the two-layers 5A and 5B constituting the surface coating layer 5 are formed from transparent thermosetting resin having a refractive index of 1.52 and their weight per unit area is 20 to 23 g/m$^2$. These thermosetting resins have a refractive index of 1.52 in this embodiment, but refractive indices of between 1.40 to 1.65 are acceptable for the present invention. This printed member 7 is formed by using a printing process, such as photogravure printing, on one of the two sub-layers 5A or 5B of the coating layer. The printed lines are less than 0.3 mm in size and are formed from transparent or semi-transparent ink having a refractive index of 1.52 (in this embodiment).

In this embodiment, the printed matter 7 becomes invisible when the reflector receives reflected light in the nighttime. This is because strong reflected light rays suppress reflections from the printed matter 7 due to the diffraction of light. However, if the width of the lines in the printed matter 7 is greater than a certain value, that part of the light irradiated area which is covered by the printed matter becomes larger than the other part, and hence even when strong reflected light is present, the printed matter 7 can no longer be completely obscured by the diffracted light, so that the printed matter becomes visible from the outside.

Therefore, the width of the lines in the printed section used in the present invention must be less than 0.5 mm. Although the printed layer 7 may have from half to complete transparency, it is desirable to maintain transmittance of the printed section 7 at 70 to 90% of that of other layers. If the transmittance of the printed layer is less than 70% of that of other layers, the light rays transmitted through the printed layer 7 in the nighttime are so reduced that they are unable to completely obscure the printed lines in said section, even with the aid of diffraction of the reflex reflected light rays that pass through the other layers, and consequently the incompletely obscured portion becomes visible as "shade" and brightness of reflection is lowered, making it impossible to accomplish the object of the present invention.

Although the printing ink and pigment used for printing in the printed section 7 can range widely in particle size from less than $1\mu$ to about $40\mu$, this particle size must be selected properly according to the color of the reflex light reflector. If the particle size of pigment is too large, this results in a reduction in transmittance, making it difficult to obscure the letters or such in the printed layer 7, even under reflected light in the nighttime. Thus, there is a certain limitation on the particle size of pigment used in the present invention. In order to prevent the printed section 7 from swelling during its formation, it is desirable to use thermosetting resin such as alkyd resin or acrylic resin for one of the coating layer 5A or 5B.

Assuming here that the thickness of the layer 5A is $d_1$, the thickness of the layer 5B is $d_2$ and the diameter of each small transparent ball 4 is D, and further assuming that the relationship of $d_1 + d_2 = \frac{1}{2} D$ holds, then it was found desirable to set the relationship of $d_2 \geqq D/4$ for certain types of printing ink. The printed matter 7 can be provided at any location within the range spanning from the rear to the front of the surface coating layer 5, but it is necessary to select this location according to the thickness of the ink used or the size of the printed lines. Also, if the distance from the small transparent balls 4 to the printed matter 7 is too great, the light rays which have passed the printed matter 7 may be diffused and become hardly perceptible. And furthermore, in case the width of the printed line is narrow, the printer matter 7 becomes invisible under the reflex reflected light ray from the outside and therefore, it can be uniformly visible by the reflex reflected light rays.

Figure 3:
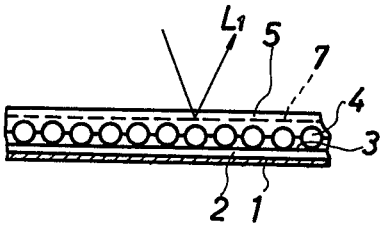
FIGS. 3 and 4 are diagrammatic drawings showing how light is reflected when the reflector receives scattered light in the daytime and reflected light in the nighttime, respectively.
Figure 4:
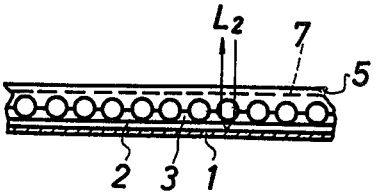

FIG. 3 shows a situation where the printed section 7 is visible owing to irregular reflection of light L1 when scattered light impinges thereon in the daytime, and FIG. 4 shows a situation where the printed surface is invisible from the outside when viewed under reflected light L2 in the nighttime.

As described above, according to the reflex light reflector of the present invention, a section printed with lines less than 0.5 mm in size is provided in the surface coating layer 5 so that such printed section 7 will be distinctly visible in scattered light in the daytime but invisible in reflected light in the nighttime, thus allowing very easy discernment.

Further, according to the present invention, since it is merely required to do the printing in the surface coating layer 5, such printing can be accomplished with ease, and also, since such printing is done between layers, it is possible to reduce the thickness of the printed layer, thus eliminating any possibility of reducing brightness even when the reflex light reflector is of a high-brightness type.

As is apparent from the foregoing description, the device according to the present invention is easy to manufacture and has many advantages that can never be obtained with conventional devices.

What is claimed is:

1. In a reflex light reflector comprising a successive reflective layer at its rear, a transparent spacer layer in front of said reflector layer, a transparent binder layer in front of said spacer layer, a plurality of small transparent balls partially embedded in said binder layer, and a transparent coating layer covering the remaining portions of said small transparent balls and having a flat outer surface, the improvement according to which printed matter is provided in said surface coating layer, the transmittance of said printed matter is 70 to 90% of the transmittance of the other layers and said printed matter is formed by lines less than 0.5 mm in width and visible from the front of said reflector when scattered light impinges thereon, but obscured by retroreflected light when the impinging light consists mainly of a narrow beam which is then retroreflected from said reflector.

2. The reflex light reflector set forth in claim 1, wherein said surface coating layer is composed of two sub-layers and a printed layer is provided on one of the adjacent surfaces of said two sub-layers.

3. The reflex light reflector claimed in claim 2, wherein the two sub-layers constituting said surface coating layer are formed from transparent thermosetting resin having a refractive index of 1.52.

4. The reflex light reflector claimed in claim 2, wherein said printed matter is photographically applied to one of the two sub-layers constituting said surface coating layer.

5. The reflex light reflector claimed in claim 2, wherein said two sub-layers constituting said surface coating layer are formed from thermosetting resin.

6. The reflex light reflector claimed in claim 2, wherein the two sub-layers constituting said surface coating layer are different from each other in thickness.

7. Reflector as claimed in claim 6 in which, when the thicknesses of the two sub-layers are $d$, and $d_2$ respectively, and the diameter of said transparent balls is $D$, $d_2 \geqq D/4$, if $d_1 + d_2 = D/2$.

8. The reflex light reflector set forth in claim 1, wherein said printed matter is made of an at least partially transparent ink having a refractive index of 1.52.

9. The reflex light reflector set forth in claim 1, wherein a printing ink and pigment are used in said printed matter and have particle sizes ranging from less than 0.0001 to about 0.004 cm.

* * * * *

UNITED STATES PATENT OFFICE

CERTIFICATE OF CORRECTION

PATENT NO. : 3,994,086

DATED : November 30, 1976

INVENTOR(S) : HISAYUKI MIZUOCHI

It is certified that error appears in the above-identified patent and that said Letters Patent are hereby corrected as shown below:

Claim 1, column 4, line 16, "reflector"

should be changed to --reflective--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*